US008668111B2

(12) United States Patent
Orr

(10) Patent No.: US 8,668,111 B2
(45) Date of Patent: Mar. 11, 2014

(54) CONTAINMENT CASE WITH LATCHING HANDLE

(75) Inventor: Kenneth Lewis Orr, Indianapolis, IN (US)

(73) Assignee: Greatbatch Ltd., Clarence, NY (US)

( * ) Notice: Subject to any disclaimer, the term of this patent is extended or adjusted under 35 U.S.C. 154(b) by 640 days.

(21) Appl. No.: 12/029,114

(22) Filed: Feb. 11, 2008

(65) Prior Publication Data

US 2008/0190932 A1 Aug. 14, 2008

Related U.S. Application Data

(60) Provisional application No. 60/900,897, filed on Feb. 12, 2007.

(51) Int. Cl.

| | |
|---|---|
| ***B65D 25/28*** | (2006.01) |
| ***B65D 45/00*** | (2006.01) |
| ***B65D 1/42*** | (2006.01) |
| ***B65D 6/34*** | (2006.01) |
| ***B65D 8/08*** | (2006.01) |
| ***B65D 25/10*** | (2006.01) |
| ***B65D 53/00*** | (2006.01) |
| ***B65D 81/24*** | (2006.01) |

(52) U.S. Cl.
USPC ..... 220/756

(58) Field of Classification Search
USPC ..... 220/763, 212.5, 318, 756, 646, 78, 761, 220/764; 292/DIG. 30
See application file for complete search history.

(56) References Cited

U.S. PATENT DOCUMENTS

| | | | | |
|---|---|---|---|---|
| 2,395,140 | A * | 2/1946 | Peterson | 294/31.2 |
| 3,082,473 | A * | 3/1963 | West | 16/445 |
| 3,233,953 | A * | 2/1966 | Seabury, Jr. | 312/244 |
| 3,273,747 | A | 9/1966 | Kalz | 220/95 |
| 3,824,733 | A | 7/1974 | Cordell, Jr. | 43/54.5 |
| 3,843,016 | A | 10/1974 | Bornhorst et al. | 220/306 |
| 3,960,474 | A | 6/1976 | Kader | 425/503 |
| 4,038,798 | A | 8/1977 | Sachs | 52/309.7 |
| 4,267,939 | A | 5/1981 | Perrett et al. | 220/318 |
| 4,331,257 | A * | 5/1982 | Taschner | 220/324 |
| 4,691,840 | A | 9/1987 | Ferbrache | 220/318 |
| 4,728,504 | A | 3/1988 | Nichols | 422/297 |
| 4,783,321 | A | 11/1988 | Spence | 422/300 |

(Continued)

FOREIGN PATENT DOCUMENTS

| | | | |
|---|---|---|---|
| EP | 0 341 330 A1 | 11/1989 | B29C 67/20 |
| EP | 0 181 119 B1 | 4/1992 | A61L 2/26 |

(Continued)

OTHER PUBLICATIONS

Merriam-Websters Online Dictionary, "Unitary" Defn. Mar. 22, 2010 (see attached).*

(Continued)

*Primary Examiner* — Anthony Stashick
*Assistant Examiner* — Andrew T Kirsch
(74) *Attorney, Agent, or Firm* — Michael F. Scalise

(57) ABSTRACT

A bail handle and containment case assembly, including a tray and closing lid, the bail handle including a portion that serves part of a latching function when in a first position over the lid and then serves part of a lifting function when pivoted off of the lid and moved into a second position.

25 Claims, 7 Drawing Sheets

(56) References Cited

U.S. PATENT DOCUMENTS

| | | | | | |
|---|---|---|---|---|---|
| 4,819,827 | A | | 4/1989 | DiSesa | 229/318 |
| 4,840,093 | A | | 6/1989 | Goldman, Jr. | 81/3.43 |
| 4,894,973 | A | | 1/1990 | Over | 52/732 |
| 4,915,913 | A | * | 4/1990 | Williams et al. | 422/119 |
| 4,981,224 | A | | 1/1991 | Rushing | 211/126 |
| 5,065,885 | A | * | 11/1991 | Scaroni | 220/326 |
| 5,103,994 | A | | 4/1992 | Doxey et al. | 220/324 |
| 5,169,018 | A | | 12/1992 | Fiore | 220/318 |
| 5,226,553 | A | | 7/1993 | Fiore | 220/318 |
| 5,351,792 | A | * | 10/1994 | Cohen | 190/18 A |
| 5,384,103 | A | | 1/1995 | Miller | 422/310 |
| 5,415,846 | A | | 5/1995 | Berry, Jr. | 422/97 |
| 5,424,048 | A | * | 6/1995 | Riley | 422/300 |
| 5,540,901 | A | | 7/1996 | Riley | 422/300 |
| 5,630,507 | A | | 5/1997 | Baker | 206/370 |
| 5,896,993 | A | | 4/1999 | Nask et al. | 206/508 |
| 5,967,392 | A | | 10/1999 | Niemi et al. | 224/404 |
| 6,079,160 | A | | 6/2000 | Bonds | 49/490.1 |
| 6,116,452 | A | * | 9/2000 | Hamel et al. | 220/318 |
| 6,138,850 | A | | 10/2000 | Berry, III | 220/4.28 |
| 6,439,625 | B1 | * | 8/2002 | Schainholz et al. | 292/307 A |
| 6,592,000 | B1 | | 7/2003 | Owens et al. | 220/324 |
| 6,679,558 | B2 | | 1/2004 | Adams et al. | 297/452.65 |
| 6,783,004 | B1 | | 8/2004 | Rinner | 206/368 |
| 6,868,970 | B2 | | 3/2005 | Gardiner et al. | 206/725 |
| 6,874,634 | B2 | | 4/2005 | Riley | 206/439 |
| 6,896,149 | B1 | | 5/2005 | Berry III | 220/4.28 |
| 6,916,123 | B2 | | 7/2005 | Kruger et al. | 385/92 |
| 6,991,108 | B1 | | 1/2006 | Rorato et al. | 206/503 |
| 7,021,485 | B1 | | 4/2006 | Baker et al. | 220/326 |
| 2003/0159390 | A1 | | 8/2003 | Fonseca | 52/408 |
| 2004/0129595 | A1 | | 7/2004 | Dane et al. | 206/503 |
| 2006/0071002 | A1 | | 4/2006 | Hurst | 220/345.1 |
| 2006/0191943 | A1 | | 8/2006 | Dane et al. | 220/501 |
| 2006/0266666 | A1 | | 11/2006 | Bettenhausen et al. | 206/370 |

FOREIGN PATENT DOCUMENTS

| | | | | |
|---|---|---|---|---|
| EP | 1 531 040 | B1 | 10/2006 | B23B 15/08 |
| EP | 1 517 077 | B1 | 1/2007 | F16L 47/30 |
| WO | WO 95/13222 | | 5/2005 | B65D 43/10 |
| WO | WO 2005/090146 | A1 | 9/2005 | B62D 29/00 |

OTHER PUBLICATIONS

Www.villagekitchen.com/mfg/bormioli/1825/leparfait__canning__jar/lkeparfait__canning__jar.html, Jan. 28, 2007, 2 pgs.

http://cgi/ebay.con/Vintage-PUTNAM-LIGHTNING-Aqua-Glass-Fruit-Canning-Jar__WOQQitemZ2900728, Jan. 28, 2007, 5 pgs.

International Search Report from PCT/US08/53591, Dated Jul. 14, 2008, 6 pgs.

* cited by examiner

CONTAINMENT CASE WITH LATCHING HANDLE

CROSS REFERENCES TO RELATED APPLICATIONS

This application claims the benefit of U.S. Provisional Patent Application No. 60/900,897, filed Feb. 12, 2007, entitled "CONTAINMENT CASE WITH LATCHING HANDLE" which is hereby incorporated by reference in its entirety.

BACKGROUND OF THE INVENTION

The present invention relates in general to containment cases and containers for retaining and storing discrete articles. More specifically, the present invention relates to a bail handle structure that is captured within a tray portion of the case and is movable into a latching position with a portion of the handle positioned on top of a closing lid.

Containment cases of the type generally described herein include a tray portion and a closing lid and are often used for medical (or dental) devices, instruments and/or equipment. These types of cases typically include a handle structure positioned at each end. While such handles are preferably attached to the tray portion, there are prior art arrangements where the handles are attached to the lid. Attachment to the tray portion is preferred for the handles since the weight of the discrete articles is supported by the tray. Attachment to the lid places added importance and load on the lid-to-tray interface connection.

The style of handle construction to be selected for this application is preferably a style that is easy to assemble and easy to use. If the handle construction is also capable of latching the lid to the tray, that is considered to be an added benefit. When a handle is constructed and arranged to function as a combined lid latch and lifting handle, two desired functions are performed by a single structure.

Prior art handles that include complex mechanisms for latching of the lid represent an added cost and unnecessary complexity. As such, it would be an improvement if a lid latching function could be provided without the referenced complexity. The disclosed bail handle is constructed and arranged to provide a convenient and easily accessible handle for lifting the corresponding case and is able to be positioned over the closing lid for latching of the lid to the tray. One bail handle is positioned at each end of the tray and each one is moveable with a pivoting action to a position wherein a portion of the handle extends over a corresponding end of the closing lid. Attempted lifting of the lid creates force vectors that are not positioned at a location nor extend in a direction relative to the handle, to be able to free each handle from its latching position over the lid. Manual grasping and lifting (pivoting) of the bail handle is required to unlatch the closing lid from the tray.

The closing lid disclosed herein, as one option, can be constructed and arranged according to U.S. patent application Ser. No. 12/029,100, entitled "Reinforcing Structure for Plastic Lid", filed Feb. 11, 2008, and further identified by. This referenced patent application is incorporated by reference in its entirety.

BRIEF SUMMARY

A bail handle and containment case assembly, including a tray and closing lid, the bail handle including a portion that serves part of a latching function when in a first position over the lid and then serves part of a lifting function when pivoted off of the lid and moved into a second position.

One object of the present disclosure is to describe a containment case and handle combination.

Related objects and advantages of the present invention will be apparent from the following description.

DETAILED DESCRIPTION

Figure 1:
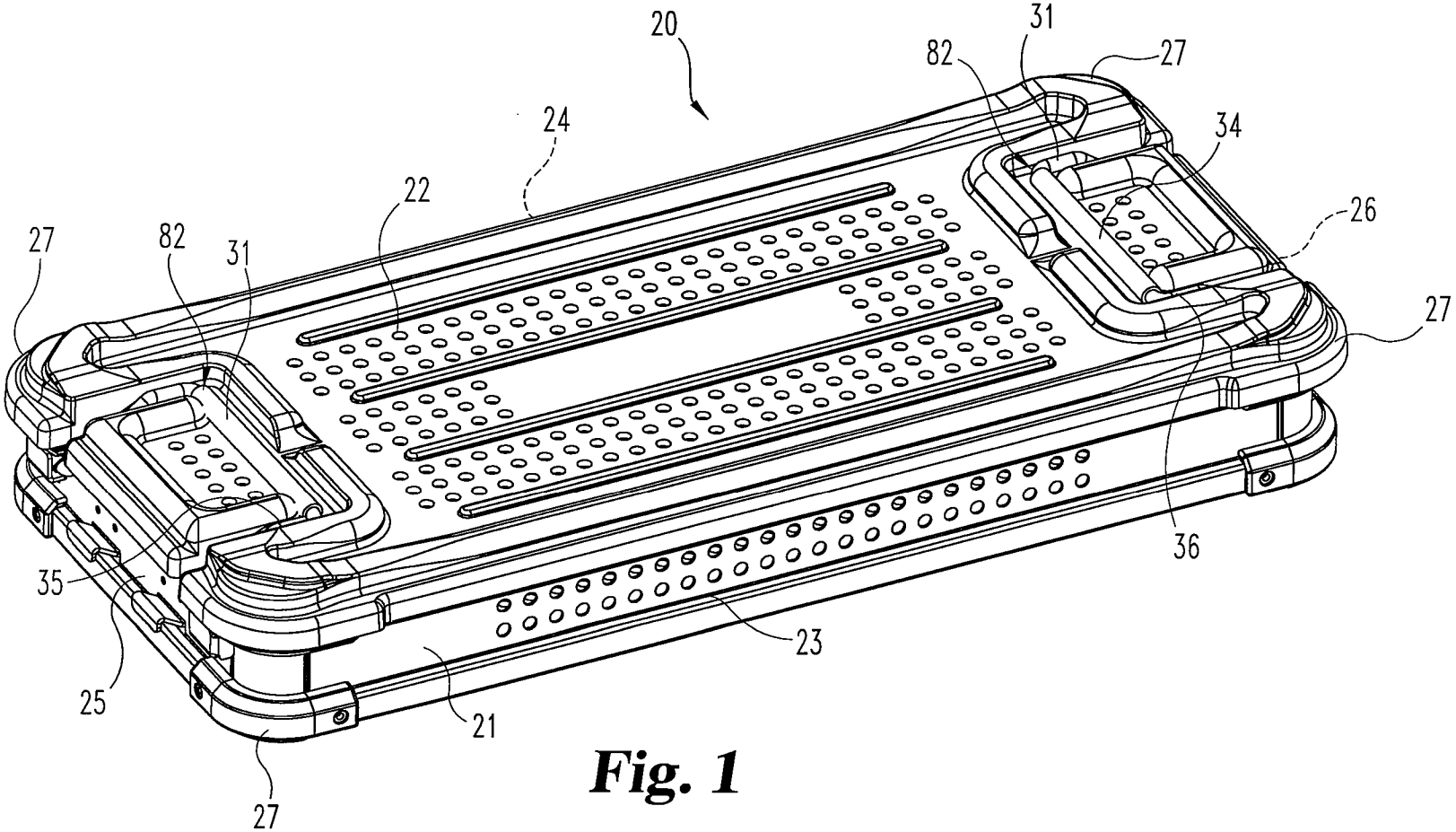
FIG. 1 is a perspective view of a containment case including a pair of handles according to the present invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Figure 2:
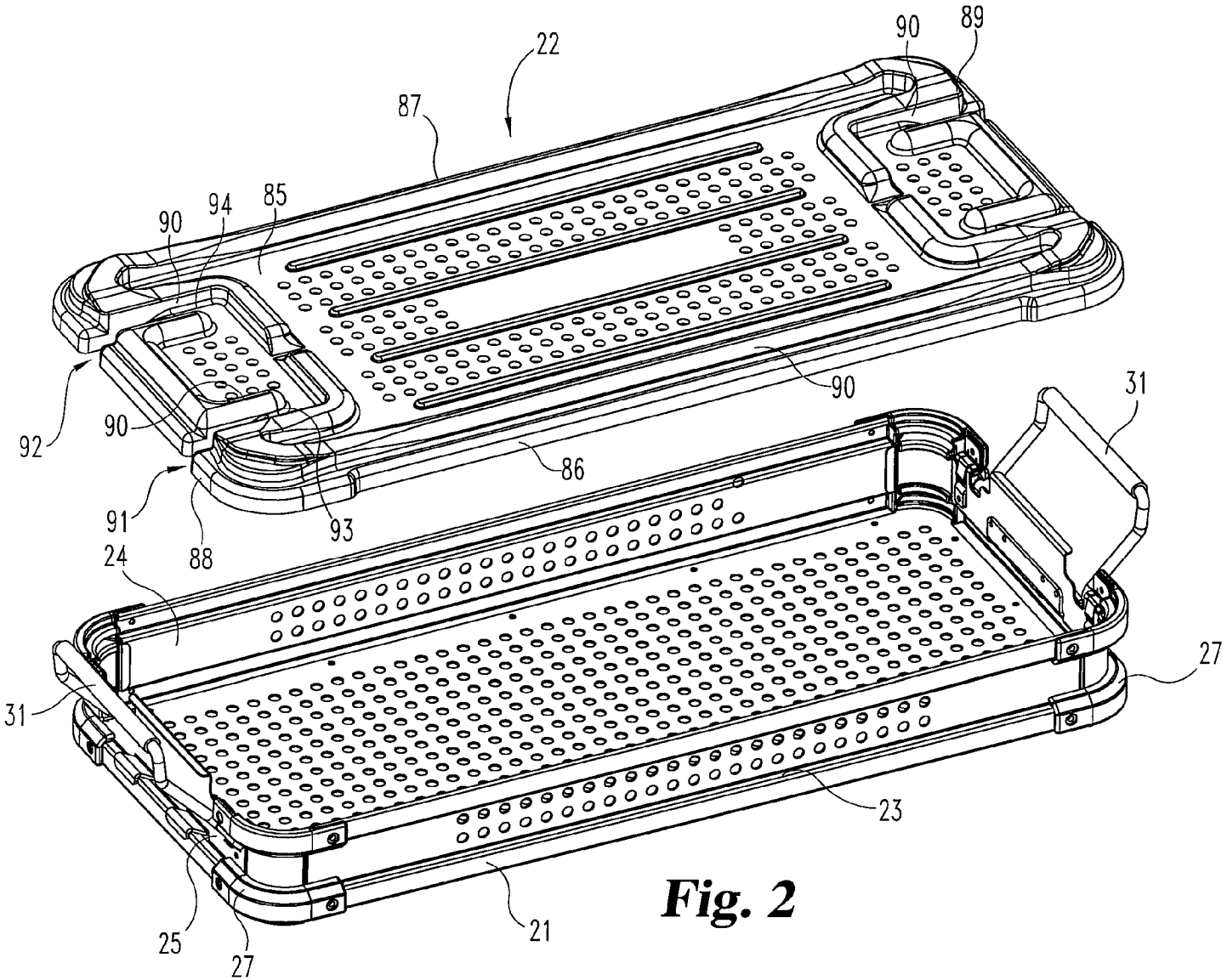
FIG. 2 is a perspective, exploded view of the lid and tray portions of the FIG. 1 case.
Figure 3:
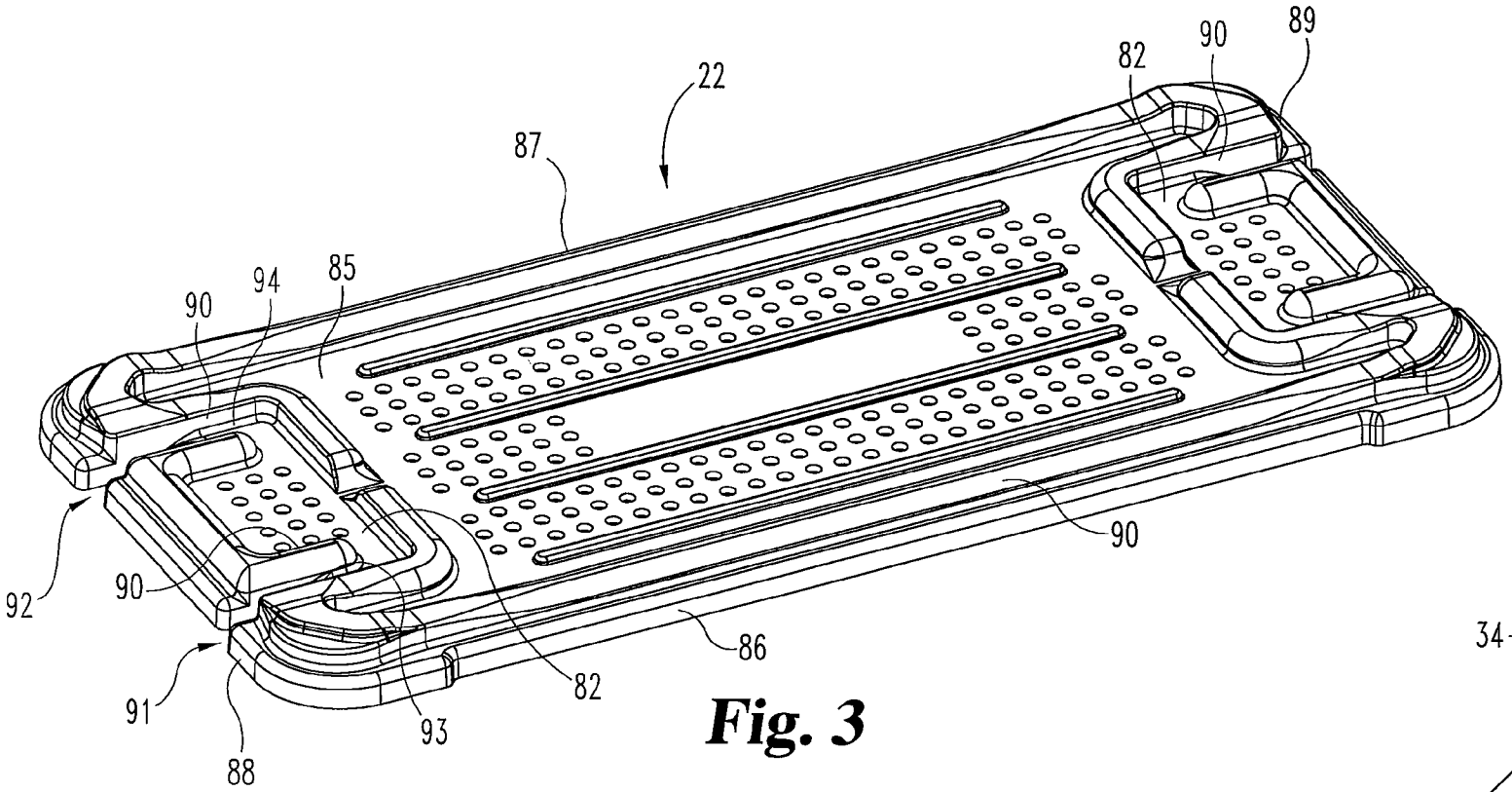
FIG. 3 is a perspective view of the closing lid comprising a portion of the FIG. 1 case.

Referring to FIGS. 1-5, there is illustrated a containment case 20 that includes a tray 21 (see FIG. 2) and a cooperating closing lid 22 (see FIG. 3). The tray 21 includes oppositely positioned and substantially parallel side walls 23 and 24, oppositely positioned end subassemblies 25 and 26, and four cooperating corner support subassemblies 27. Each corner support subassembly 27 has a first pair of rivet holes for assembly to one of the two side walls and a second pair of rivet holes for assembly to one of the two end subassemblies. Tray 21 further includes a floor panel 30 and a pair of bail handles 31, each handle 31 being captured by a corresponding end subassembly. While the side walls 23 and 24, end subassemblies 25 and 26, four corner support subassemblies 27, and floor panel 30 are all securely and cooperatively connected together, preferably by rivets, the bail handles 31 are simply captured, without being pinned, riveted, or otherwise rigidly connected.

Figure 4:
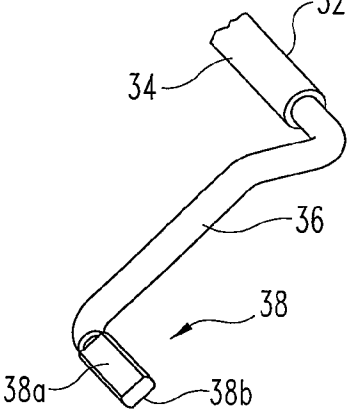
FIG. 4 is a perspective view, in full section, of a free end of one handle.

With continued reference to FIG. 2, each unitary bail handle 31 is of a formed metal shape having a substantially straight central gripping portion 34, contoured sides 35 and 36, and free end pivot posts 37 and 38. The two pivot posts 37 and 38 are coaxial with each other and centered on pivot axis 39. Pivot axis 39 is parallel with the longitudinal axis 40 and gripping portion 34. Each pivot post 37 and 38 includes a pair of opposing flattened sides 37*a* and 37*b* for post 37 and 38*a* and 38*b* for pivot post 38, as shown in FIG. 4.

Figure 5:
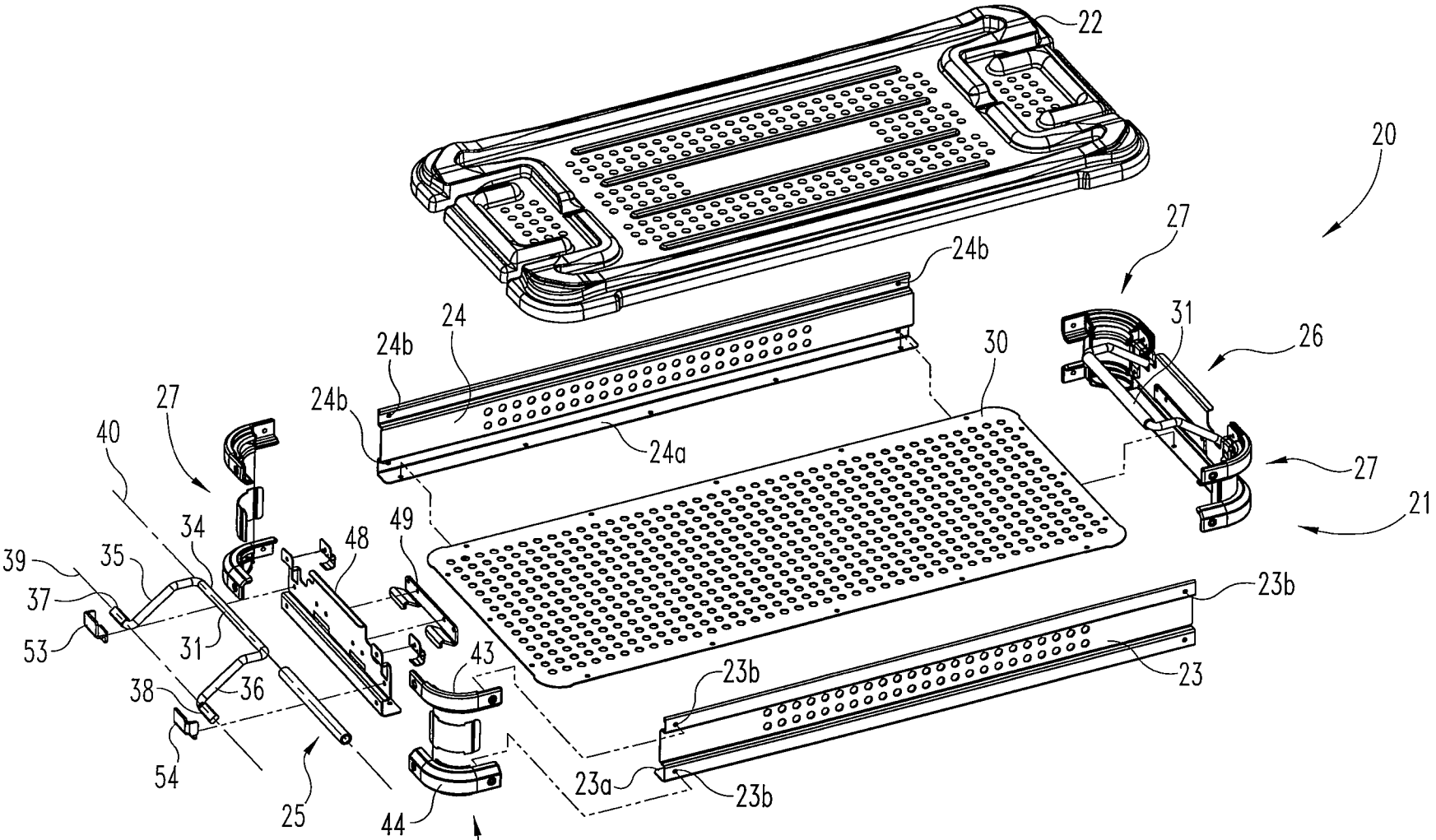
FIG. 5 is a perspective, exploded view of the FIG. 1 containment case.

With reference to FIG. 5, each sidewall 23 and 24 includes a lower lip 23*a* and 24*a*, respectively, that is generally parallel with the plane of floor panel 30. The outer side edges of floor panel 30 are received by lower lips 23*a* and 24*a* and then riveted together.

Figure 7A:
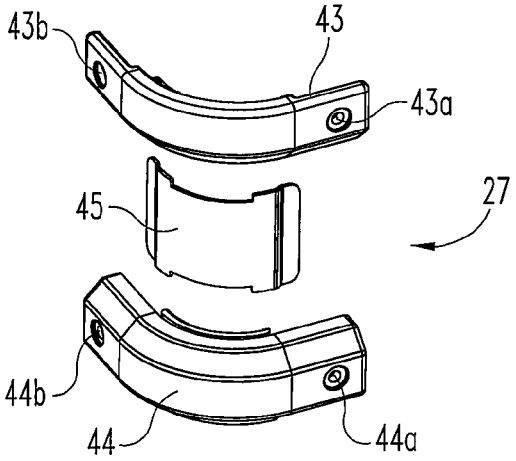
FIG. 7A is a perspective, exploded view of a corner support subassembly comprising a portion of the FIG. 1 containment case.
Figure 7B:
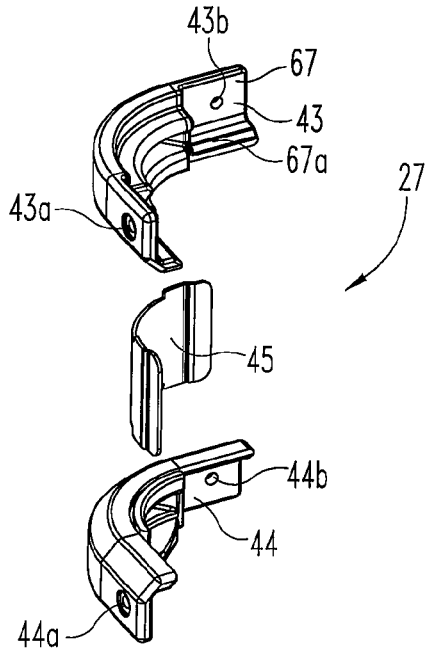
FIG. 7B is a perspective, exploded view of the corner support subassembly comprising a portion of the FIG. 1 containment case.

The ends of each sidewall 23 and 24 define a pair of spaced-apart rivet holes (four total) 23*b* and 24*b*, respectively. These rivet holes align with rivet holes in the upper and lower components 43 and 44, respectively, of the corner support subassembly 27, see also FIGS. 7A and 7B. The third component of each corner support subassembly 27 is a curved panel 45 that is notched along its upper and lower edges and captured between components 43 and 44. Each of the four subassemblies 27 are similarly constructed and arranged and similarly assembled to the remainder of tray 21.

Rivet holes 43*a* and 44*a* align with the upper and lower rivet holes 23*b*. By riveting these component parts together, the sidewalls 23 and 24 and floor panel 30 are securely assembled with the four corner support subassemblies 27. The concluding portions for completion of the tray 21 construction are end subassemblies 25 and 26, see FIG. 6. These two end subassemblies 25 and 26 are the same and the description and explanation of one subassembly 25 will suffice for the description and explanation of the other subassembly 26. It should also be noted at this point that, although reference is made throughout to the various component parts having rivet holes and being riveted together, rivets could be replaced by other fasteners and/or other fastening means. However, the use of rivet holes and rivets is believed to be preferred.

Each subassembly 25, located at one end of tray 21, is positioned between and assembles to a pair of corner support subassemblies 27 (see FIG. 5). The component parts that are used in combination to create end subassembly 25 (and its opposite counterpart end subassembly 26) include end plate 48, retainer 49, spring steel handle clips 50 and 51, bail handle 31, gripping sleeve 52, and handle covers 53 and 54.

Figure 6:
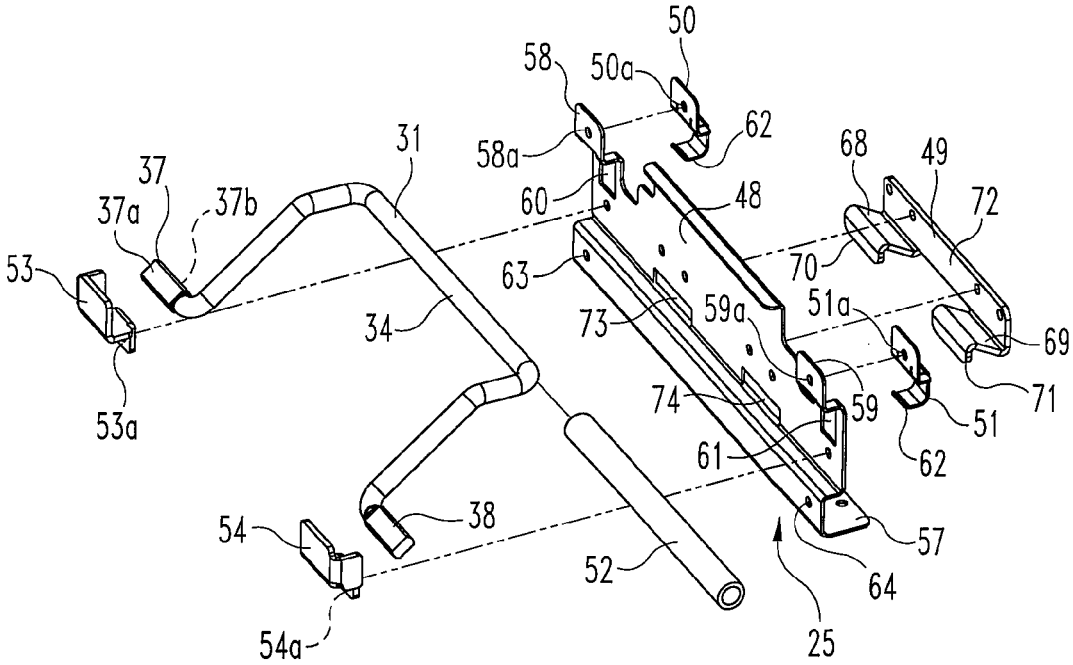
FIG. 6 is a perspective, exploded view of an end subassembly comprising a portion of the FIG. 1 containment case.

End plate 48 is a sheet metal stamping formed with the edge shape, openings, notches and bends as illustrated in FIGS. 5 and 6. Lower lip 57 includes three rivet holes that align with the three rivet holes in each end of floor panel 30. Upper tabs 58 and 59 are above corresponding openings 60 and 61, respectively. The rivet holes 58*a* and 59*a* align with rivet holes 50*a* and 51*a* of spring clips 50 and 51, respectively. This riveting location at an upper end of each clip 50 and 51 relative to the lower end location of curved lip 62 allows the curved lip 62 to pivot or at least deflect due to movement of the free ends of handle 31, as will be described in conjunction with other drawing figures. Additionally, the "other" rivet holes 43*b* of each subassembly 27 (those on opposite ends of subassembly 25) are aligned (one each) with aligned holes 58*a* and 50*a* and with aligned holes 59*a* and 51*a*. The lower rivet holes 44*b* of each subassembly 27 are aligned with cooperating rivet holes in the lower corners of end plate 48. These various groupings of aligned rivet holes are riveted together as part of the overall preferred construction and assembly of end subassembly 25 and of tray 21.

Each spring steel clip 50 and 51 is shaped with a curved lower lip 62 whose concave shape opens upwardly based on a general horizontal orientation of tray 21. Each lower lip 62 extends through a corresponding opening 60 and 61 and is used as part of a capturing structure for the free ends (i.e., end pivot posts 37 and 38) of handle 31. Another portion of the construction of subassembly 25 that is used as part of a capturing structure for each of the free ends of posts 37 and 38 of handle 31 is cover 53 at one end and cover 54 at the opposite end or side. One cover 53 is used for one end pivot post and the other cover 54 is used for the other end pivot post. Each cover 53 and 54 includes a rivet hole 53*a* and 54*a*, respectively, that is aligned with a corresponding and cooperating rivet hole 63 and 64 in end plate 48. This aligned combination of parts is riveted together.

The final component part that is utilized as a portion for the overall construction for capturing each post 37 and 38 of each handle 31 is one end portion of each upper component 43. The referenced "one end portion" is the end or side edge of the particular subassembly 27 that is adjacent the corresponding end subassembly 25 and 26. Upper component 43 includes at each outer edge a recessed portion 67 surrounding rivet hole 43*b* in one instance and rivet hole 43*a* on the other or opposite side of subassembly 25. Recessed portion 67 extends into an inwardly-directed, lower lip 67*a*. Lower lip 67*a* extends over the upper edge of its corresponding end pivot post 37 and 38. See FIGS. 8A, 8B, and 8C.

Figure 9:
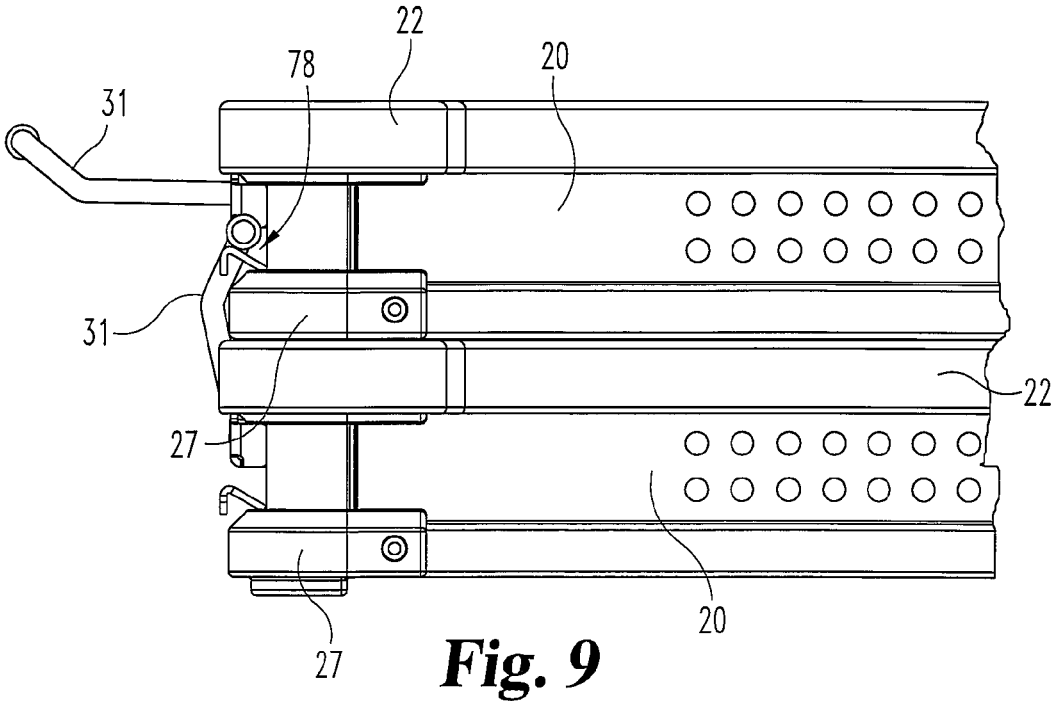
FIG. 9 is a partial, side elevational view of two FIG. 1 cases stacked together and secured by one handle.

Retainer 49 includes two inclined tabs 68 and 69, each with an outer, depending lip 70 and 71, respectively. The upper panel body 72 of retainer 49 includes four rivet holes that are aligned with four corresponding and cooperating rivet holes in end plate 48. Further, end plate 48 defines two spaced-apart, generally rectangular openings 73 and 74. As is illustrated in the exploded view of FIG. 5, the inclined tabs 68 and 69 of retainer 49 are inserted through openings 73 and 74 prior to riveting retainer 49 and end plate 48 together using the four pairs of aligned rivet holes. The inclined surface of each tab 68 and 69 is used as the securement location for the latching handles 31 of a lower containment case when two or more containment cases are being stacked, one on top of the other. The handles 31 of the lower case 20 typically include sleeve 52 that is slipped over the handle 31 and positioned around the gripping portion. This sleeve not only provides gripping comfort to the hands of the user, but can compress slightly when moved into position into the receiving space of the upper case when multiple cases are stacked together. As is illustrated in FIG. 9, when one case is stacked onto the top of another case, handle 31, with the rubber or synthetic material sleeve 52 in place, is pivoted up and moved into space 78 that is located directly above tabs 68 and 69. The overall size of space 78 and the size, shape, and location of tabs 68 and 69 provides a sufficient degree of interference such that the sleeve 52 may be compressed slightly when fitting into space 78 in the upper case. This helps to retain the handle 31 in this position and sleeve 52 helps to prevent any metal-to-metal contact that might result in vibration and/or noise. The upwardly inclined nature of tabs 68 and 69 helps to ensure that the securing handle located in space 78 does not inadvertently come free. Space 78 is illustrated in FIGS. 8A-8C.

Figure 8:
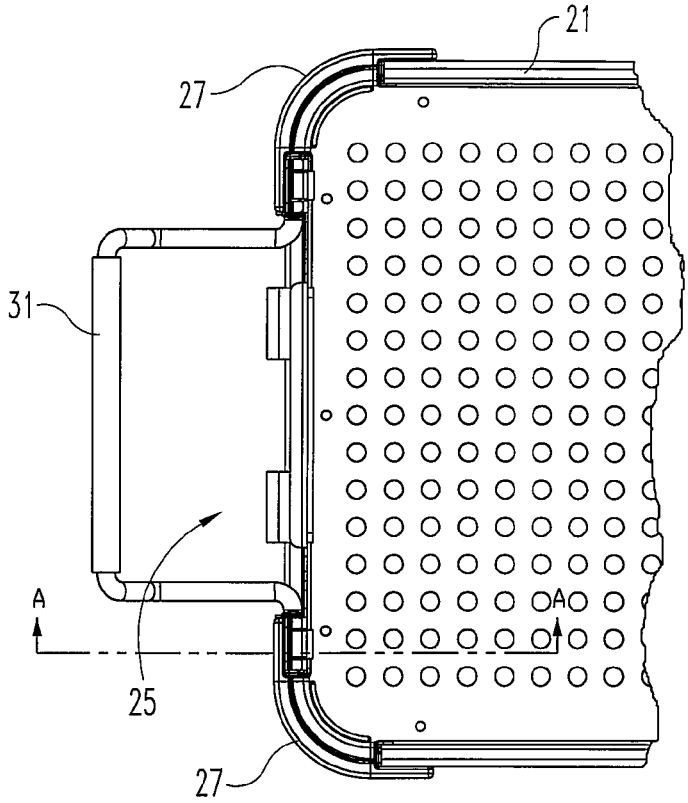
FIG. 8 is a partial, top plan view of the FIG. 2 tray with a cutting plane for FIGS. 8A-8C.
Figure 8A:
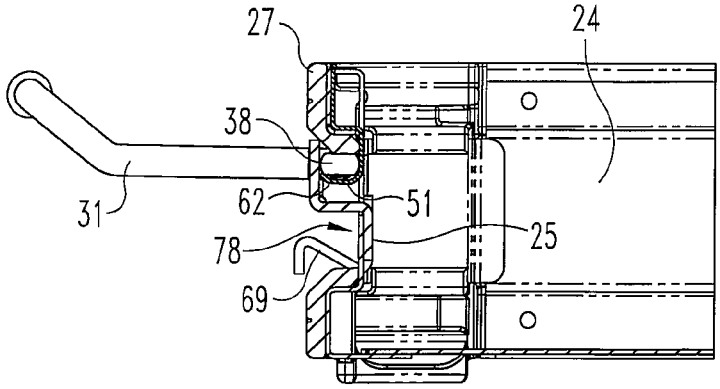
FIG. 8A is a partial, side elevational view of one end of the FIG. 2 tray, as viewed along line A-A in FIG. 8 with the handle in an open orientation.
Figure 8B:
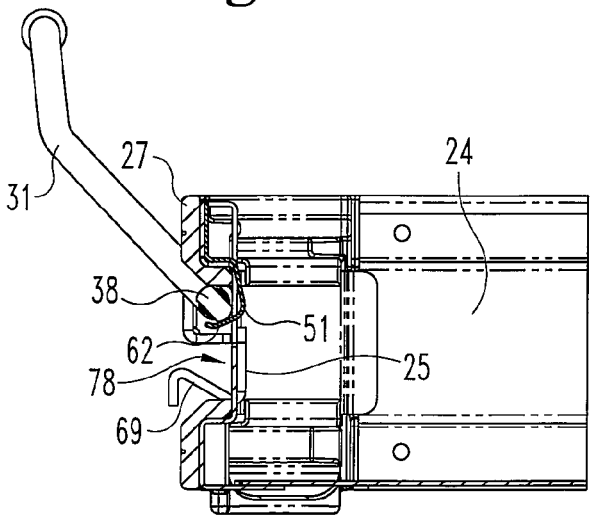
FIG. 8B is a partial, side elevational view of one end of the FIG. 2 tray, as viewed along line A-A in FIG. 8 with the handle in a lifting orientation.
Figure 8C:
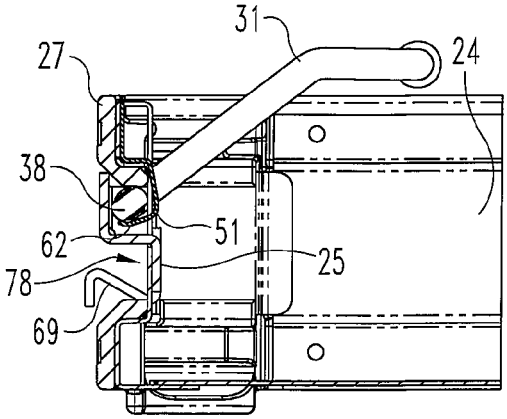
FIG. 8C is a partial, side elevational view of one end of the FIG. 2 tray, as viewed along line A-A in FIG. 8 with the handle in a latching orientation.

Referring now to FIGS. 8, 8A, 8B, and 8C, the various positions for handle 31 are illustrated. FIG. 8 is a partial, top plan view of tray 21 and provides the location for the cutting plane for the section views of FIGS. 8A, 8B, and 8C. Also illustrated by the three partial, side elevational views, in partial section, is the construction of one end subassembly 25 and part of one corner support subassembly 27. As should be clear from the exploded view of FIG. 5 and the overall symmetry of case 20, the two subassemblies 25 and 26 are configured in the same manner. Similarly, all four subassemblies 27 are configured the same. The connection of one subassembly 27 to one side of one subassembly 25 is the same as the connection of the opposite subassembly 27 to the other side of that same subassembly 25, except for left hand versus right hand differences. Nevertheless, there is an overall balance and symmetry to all of the component parts, as would be clear from the drawings that are provided as part of this disclosure. The assembly, construction, and configuration of the opposite end of tray 21 is the same as that illustrated as the first end of tray 21.

With continued reference to FIGS. 4, 8, 8A, 8B, and 8C, end pivot post 37 and end pivot post 38 of handle 31 are identical to each other. Each end pivot post includes opposing flattened sides 37*a* and 37*b* for post 37 and sides 38*a* and 38*b* for post 38. Post 38 is the one illustrated in FIGS. 8A-8C. The flattened sides 38*a* and 38*b* and, on the opposite post sides 37*a* and 37*b*, provide a cam action due to different dimensions being presented from the pivot axis 39 outwardly to different portions of the outer surface of post 38 as that outer surface makes contact with clip 51. FIG. 8A is best described as an open position wherein handle 31 is pivoted outwardly and downwardly such that the flattened surfaces 38*a* and 38*b* are generally parallel with floor panel 30 which is generally horizontal in the illustrated orientation. This handle orientation allows clip 51 to remain in a generally unsprung or undeflected condition.

When moving handle 31 from the FIG. 8A position to the FIG. 8B position, there is a camming action due to the shape of free end 38, the different dimensions of that free end based on the pivot axis 39, and the location of spring steel clip 51. The direction of movement from the FIG. 8A position to the FIG. 8B position can be thought of as clockwise rotation or pivoting based on the views and orientations of tray 21, as depicted by FIGS. 8A-8C. In terms of the camming action due to the shape of free end 38, the pivoting of handle 31 in this clockwise direction pushes the "long dimension" of end 38, and the same would be true for end 37, against lip 62, moving lip 62 by deflecting or flexing clip 51. This specific position of handle 31 as illustrated in FIG. 8B is the upright or lifting position for handles 31. The angles and curvature of handle 31 and the cooperating form of end 38 in conjunction with clip 51 results in the FIG. 8B orientation. In this orientation, the gripping portion 34, covered by sleeve 52, is accessible to the user. There is adequate clearance space for a user's hand to be inserted between the handle 31 and tray 21, from either direction, without interference with the tray 21 or closing lid 22, if the lid is assembled. The spring back force exerted by clip 51 onto post 38 (and by clip 50 onto post 37) is due in part to the spring steel construction of clips 51 and 50 and is due in part to the ability of these clips to deflect, considering the upper rivet location. The force that is exerted on posts 38 and 37 causes the handle 31 to remain in this lifting position, until moved manually.

When moving handle 31 from a lifting position orientation to the lid latching position of FIG. 8C, the clockwise motion of handle 31, based on the view of the drawing and cutting plane, turns end 38 such that the dimension from the pivot axis 39 to the surface of clip 51, as controlled by the shape and orientation of end or post 38, is less than the corresponding dimension in FIG. 8B. This motion also relieves some of the spring force. There is still some slight deflection of clip 51 and thus some slight force on post 38 (and post 37), causing the handle to remain in this lid-latching orientation, until the handle is lifted by a user. Counter clockwise motion will increase the spring clip force and thus moving from the FIG. 8C orientation back toward the FIG. 8B orientation requires an intentional act by a user.

In the lid latching orientation of FIG. 8C, the sleeved portion of handle 31 fits down into a similarly shaped relief area 82 that is formed as part of lid 22 (see FIG. 1). It is also noted that while FIG. 1 shows the entire case 20 with the handles in the FIG. 8C latching position, FIG. 8C is provided without the lid 22 in position on the tray 21. From the foregoing description and based on a force vector analysis, it will be clear that any attempt to manually lift the lid 22 off of the tray 21 while the latching handles 31 are in their lid-latching position (see FIGS. 1 and 8C), will not be successful. Whether lifting up on lid 22 or trying to pry off lid 22, the latching handles are adequate to prevent such lid removal from tray 21.

If the lid reinforcement technology of my referenced and co-pending application is used for lid 22, then the added rigidity of the lid significantly restricts any tray access that might otherwise be attempted by lifting or prying up on the lid 22 edge along the longitudinal side.

Referring to FIG. 9, an end portion of two stacked cases is illustrated in order to show how the handle 31 of the lower case fits into area 78 of the upper case and is secured in position by the slight compression of sleeve 52 and by the overall size and shape of area 78 and by the inclined ramp shape of tabs 68 and 69. As such, the construction and arrangement of handle 31 serves the functions of case lifting, lid latching, and case stacking. The (single) case lifting is achieved by use of the handles 31 that are secured to the tray and thus a better weight distribution and balance than attaching the handles to the lid. The lid latching allows the elimination of slide latches, with the handle doubling as both the handle and the latch. When lid reinforcement is used, there is every reason to believe that slide latches along the length dimension of the sides could be eliminated. Accordingly, the lid construction, as illustrated herein, does not include any slide latches along any of the four sides. With sufficient lid rigidity, and the latching handles 31 as disclosed herein, nothing more is needed for proper securement of the lid 22 to the tray 21 in order to create containment case 20. The case stacking uses the lower handle for the upper case and thus still provides the upper case handle for lifting of the entire stack. The cases are stacked which means that the closing lids are applied. In this regard, it is important to note that the lower surface construction of one tray is compatible with the overall size, shape, and geometry of the upper surface of the closing lid of the lower tray. As will be seen, each closing lid 22 has raised ribs and forms and, at the four corners, those raised forms are inset slightly from the outer periphery of the lid. This allows the subassemblies 27 of the upper tray to rest down onto those recessed corner plateaus and the construction of subassemblies 27 allows the raised rib forms of the lower lid to fit inside of subassemblies 27 of the upper tray. As such, there is a nesting structure created based upon the overall shape of lid 22 and the complementing shape of the lower surface of the tray and, in particular, the four corner support subassemblies 27.

With further reference to FIG. 3, unitary, molded plastic closing lid 22 includes a main panel 85 bounded by opposite side edges 86 and 87 and opposite end edges 88 and 89. A pattern of raised ribs 90 is included as part of panel 85. Adjacent to and formed through each end edge 88 and 89 are a pair of handle clearance notches 91 and 92. These spaced apart clearance notches 91 and 92 extend into recessed handle channels 93 and 94 that extend into relief area 82 for receiving the contoured sides 35 and 36 and gripping portion 34 (with sleeve 52) of the corresponding handle 31. The surrounding raised ribs 90 create a type of receiving pocket for handles 31 as illustrated in FIG. 1. The simplicity of the handle construction as disclosed herein allows the two handles 31 to be easily manufactured with the desired shapes and easily assembled by having the end pivot posts 37 and 38 captured between other component parts.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A case for discrete articles, comprising:

a) a tray;

b) a closing lid including a main panel bounded by opposite side edges and opposite end edges, wherein the closing lid supports a first receiving pocket formed from a pattern of raised ribs extending upwardly from an upper surface of the main panel; and c) a first latching handle assembled to the tray and comprising first and second handle sides extending from opposed distal handle side portions to respective first and second free ends pivotably connected to the tray with an intermediate handle gripping portion disposed between the first and second handle sides, wherein at least one of the first and second free ends of the first handle is constructed and arranged with an intermediate first curved surface meeting a first flattened surface and a spaced apart second flattened surface;

d) a first end plate;

e) a first spring clip secured to the first end plate;

f) a first handle cover cooperating with the first spring clip to capture the at least one of the first and second free ends of the first handle therebetween, g) wherein the first handle is movable to cause the first spring clip to bear against the first flattened surface to thereby retain the first handle in an unlatched position with the handle gripping portion extending away from the tray and wherein the first handle is further movable to cause the first spring clip to bear against the second flattened surface to thereby retain the first handle in a latched position with a portion of the first handle extending over a portion of the lid main panel with the spring clip remaining in contact with at least a portion of the first curved surface regardless whether the first handle is in the latched or unlatched position, and h) wherein, in the latched position, the handle gripping portion and at least a first portion of the first and second handle sides are nested in the first receiving pocket supported on the upper surface of the closing lid to thereby latch the closing lid to the tray.

2. The case of claim 1 wherein the tray includes an end subassembly that includes the first handle.

3. The case of claim 1 wherein the first and second free ends of the first handle are centered on a common pivot axis.

4. The case of claim 1 wherein the tray includes a pair of end subassemblies, each end subassembly being located at an end of the tray, and wherein one of the end subassemblies includes the first handle with the other end subassembly including a second latching handle.

5. The case of claim 1 which further includes a retainer, wherein the retainer includes an outwardly extending tab for use in connecting together two stacked cases, the tab cooperating to define an area of one, upper case for receipt of a latching handle of a second, lower case.

6. The case of claim 4 which further includes a plurality of corner support subassemblies, wherein a portion of a corner support subassembly is assembled to a portion of one of the end subassemblies.

7. The case of claim 1 which includes a second receiving pocket formed from a second pattern of raised ribs extending upwardly from the upper surface of the main panel and wherein a second latching handle is assembled to the tray, the second handle comprising:

a) third and fourth handle sides extending from opposed distal handle side portions to respective third and fourth free ends pivotably connected to the tray with an intermediate handle gripping portion disposed between the third and fourth handle sides, wherein at least one of the third and fourth free ends of the second handle is constructed and arranged with an intermediate second curved surface meeting a third flattened surface and a spaced apart fourth flattened surface;

b) a second end plate;

c) a second spring clip secured to the second end plate;

d) a second handle cover cooperating with the second spring clip to capture the at least one of the third and fourth free ends of the second handle therebetween, e) wherein the second handle is movable to cause the second spring clip to bear against the third flattened surface to thereby retain the second handle in an unlatched position with the handle gripping portion extending away from the tray and wherein the second handle is further manipulatable to cause the second spring clip to bear against the fourth flattened surface to thereby retain the second handle in a latched position with a portion of the second handle extending over a portion of the lid main panel with the second spring clip remaining in contact with at least a portion of the second curved surface regardless whether the second handle is in the latched or unlatched position, and f) wherein, in the latched position, the handle gripping portion and at least a portion of the third and fourth handle sides are nested in the second receiving pocket supported on the upper surface of the closing lid to thereby latch the closing lid to the tray.

8. The case of claim 1 wherein a pair of side-by-side clearance notches extends inwardly from a side edge of the main panel adjacent to the first handle so that with the first handle in the latched position, the clearance notches receive a second portion of the first and second handle sides while the handle gripping portion and the first portion of the first and second handle sides nest in the first receiving pocket supported on the upper surface of the closing lid.

9. The case of claim 3 wherein the first and second free ends of the first handle centered on the common pivot axis point in opposite directions.

10. The case of claim 9 wherein the first flattened surface of the at least one of the first and second free ends of the first handle is generally parallel to the second flattened surface.

11. The case of claim 1 wherein the first spring clip is attached to one portion of the end plate and the first handle cover is attached to another portion of the end plate.

12. The case of claim 11 which further includes a second spring clip and a second handle cover constructed and arranged as part of the first handle for capturing the second free end of the first handle.

13. The case of claim 12 wherein the first spring clip is attached to one portion of the first end plate, the second spring clip is attached to a second portion of the first end plate, the first handle cover is attached to a third portion of the first end plate and the second handle cover is attached to a fourth portion of the first end plate.

14. The case of claim 4 wherein each end subassembly includes a spring clip as one component cooperating with another component to capture the first free end of the first handle.

15. The case of claim 14 wherein each end subassembly includes a handle cover as the another component cooperating with the spring clip to capture the first free end of the first handle.

16. The case of claim 2 wherein the end subassembly includes a retainer, the retainer including an outwardly extending tab for use in connecting together two stacked cases, the tab cooperating to define an area of one, upper case for receipt of a latching handle of a second, lower case.

17. A case for discrete articles, comprising:

a) a tray;

b) a closing lid including a main panel bounded by opposite side edges and opposite end edges, wherein the closing lid supports first and second receiving pockets, each pocket being formed from a pattern of raised ribs extending upwardly from an upper surface of the main panel adjacent to the respective end edges;

c) a first latching handle assembled to the tray and comprising:

i) first and second handle sides extending from opposed distal handle side portions to respective first and second free ends pivotably connected to the tray with an intermediate handle gripping portion disposed between the first and second handle sides, wherein at least one of the first and second free ends of the first handle is constructed and arranged with an intermediate first curved surface meeting a first flattened surface and a spaced apart second flattened surface;

ii) a first end plate;

iii) a first spring clip secured to the first end plate;

iv) a first handle cover cooperating with the first spring clip to capture the at least one of the first and second free ends of the first handle therebetween;

d) a second latching handle assembled to the tray and comprising:

i) third and fourth handle sides extending from opposed distal side portions to respective third and fourth free ends pivotably connected to the tray with an intermediate handle gripping portion disposed between the third and fourth handle sides, wherein at least one of the third and fourth free ends of the second handle is constructed and arranged with an intermediate second curved surface meeting a third flattened surface and a spaced apart fourth flattened surface;

ii) a second end plate;

iii) a second spring clip secured to the second end plate;

iv) a second handle cover cooperating with the second spring clip to capture the at least one of the third and fourth free ends of the second handle therebetween; and e) wherein the first and second handles are movable to cause their respective first and second spring clips to bear against, the first and third flattened surfaces to thereby retain the first and second handles in an unlatched position with their handle gripping portions extending away from the tray and wherein the first and second handles are further movable to cause the first and second spring clips to bear against the second and fourth flattened surfaces to thereby retain the first and second handles in latched positions with a portion of the first and second handles extending over a portion of the lid main panel with the first and second spring clips in contact with at least a portion of the respective first and second curved surfaces regardless whether the first and second handled are in the latched or unlatched positions, and f) wherein, in the latched positions, the handle gripping portions and at least a first portion of the first and second handle sides and at least a first portion of the third and fourth handle sides are nested in the respective first and second receiving pockets supported on the upper surface of the closing lid to thereby latch the closing lid to the tray

18. The case of claim 17 wherein a pair of side-by-side clearance notches extend inwardly from each of the opposed side edges of the main panel adjacent to the respective first and second handles so that with the handles in the latched position, the clearance notches receive second portions of the respective first and second handle sides and the third and fourth handle sides while the handle gripping portions and at least first portions of the handle sides nest in the respective first and second receiving pockets supported on the upper surface of the closing lid.

19. The case of claim 1 wherein the handle is movable to cause the spring clip to bear against intermediate curved surface of the at least one first and second free end between the first and second flattened sides to thereby retain the handle in a lifting position intermediate the latched and unlatched positions.

20. A case for discrete articles, comprising:

a) a tray;

b) a closing lid including a main panel bounded by opposite side edges and opposite end edges, wherein the closing lid supports a first receiving pocket formed from a pattern of raised ribs extending upwardly from an upper surface of the main panel; and c) a latching handle assembled to the tray and comprising first and second handle sides extending from opposed distal handle side portions to respective first and second free ends pivotably connected to the tray with an intermediate handle gripping portion disposed between the first and second handle sides, wherein the first and second free ends of the handle are both constructed and arranged with an intermediate curved surface meeting a first flattened surface and an opposed parallel second flattened surface;

d) an end plate;

e) a spring clip secured to the end plate;

f) a handle cover cooperating with the spring clip to capture the at least one of the first and second free ends of the handle therebetween, g) wherein the handle is movable to cause the spring clip to bear against the first flattened surface to thereby retain the handle in unlatched position with the handle gripping portion extending away from the tray and wherein the handle is further movable to cause the first spring clip to bear against the second flattened surface to thereby retain the handle in a latched position with a portion of the latching handle extending over a portion of the lid main panel with the spring clip remaining in contact with at least a portion of the curved surface regardless whether the handle is in the latched or unlatched position, and h) wherein in the latched position the handle gripping portion and at least a first portion of the first and second handle sides are nested in the receiving pocket supported on the upper surface of the closing lid to thereby latch the closing lid to the tray.

21. The case of claim 20 wherein the handle is movable to cause the spring clip to bear against the intermediate curved surface of the at least one first and second free ends between the first and second flattened sides to thereby retain the handle in a lifting position intermediate the latched and unlatched positions.

22. The case of claim 1 wherein the first curved surface is opposite the gripping portion of the first handle.

23. The case of claim 7 wherein the second curved surface is opposite the gripping portion of the second handle.

24. The case of claim 17 wherein the first and second curved surfaces are opposite the intermediate handle gripping portions of the respective first and second handles.

25. The case of claim 20 wherein the curved surface is opposite the handle gripping portion.

* * * * *

UNITED STATES PATENT AND TRADEMARK OFFICE

CERTIFICATE OF CORRECTION

PATENT NO. : 8,668,111 B2
APPLICATION NO. : 12/029114
DATED : March 11, 2014
INVENTOR(S) : Kenneth Lewis Orr It is certified that error appears in the above-identified patent and that said Letters Patent is hereby corrected as shown below:

In the Claims

Column 9, line 60 after the word "against" delete the ","

Column 10, line 5 delete "handled" and insert --handles--

Signed and Sealed this
Eighth Day of September, 2015

Michelle K. Lee

Michelle K. Lee
*Director of the United States Patent and Trademark Office*